US007399135B2

(12) United States Patent
Lee

(10) Patent No.: US 7,399,135 B2
(45) Date of Patent: Jul. 15, 2008

(54) PEN WITH FLASHY BARREL

(75) Inventor: Carson Kar-Sein Lee, Pomona, CA (US)

(73) Assignee: Baily Promo Products (Shen Zhen) Co., Guang Dong Province (CN)

( * ) Notice: Subject to any disclaimer, the term of this patent is extended or adjusted under 35 U.S.C. 154(b) by 147 days.

(21) Appl. No.: 11/477,357

(22) Filed: Jun. 30, 2006

(65) Prior Publication Data

US 2008/0003050 A1 Jan. 3, 2008

(51) Int. Cl.
*B43K 29/00* (2006.01)
*B43K 5/12* (2006.01)

(52) U.S. Cl. ..... 401/195; 401/192

(58) Field of Classification Search ..... 401/52, 401/192, 195, 32, 30, 116, 117, 107, 108, 401/112

See application file for complete search history.

(56) References Cited

U.S. PATENT DOCUMENTS

| | | | | |
|---|---|---|---|---|
| 2,162,223 A * | 6/1939 | Larsen | ..... | 401/192 |
| 3,250,033 A * | 5/1966 | Siegel | ..... | 40/334 |
| 5,048,991 A * | 9/1991 | Guo | ..... | 401/116 |
| 6,375,376 B1 * | 4/2002 | Hsu | ..... | 401/247 |

* cited by examiner

*Primary Examiner*—David J Walczak
(74) *Attorney, Agent, or Firm*—Rosenberg, Klein & Lee

(57) ABSTRACT

A pen comprises a barrel having a first tube and a second tube coaxially overlaying the first tube. The first tube has a pattern area defined by a plurality of parallel lines thereon; and the second tube is transparent and has a plurality of parallel protrusions formed thereon; wherein one of the first tube and the second tube is movable relative to another; and the parallel lines of the first tube are parallel with the parallel protrusions of the second tube.

4 Claims, 6 Drawing Sheets

PEN WITH FLASHY BARREL

TECHNICAL FIELD

The present invention relates to a pen and in particular to a pen with decorative designs.

BACKGROUND OF THE INVENTION

Pens that have decorative designs to perform vision effects are known in the arts. One prior art is found in Taiwan Patent Application No. 093217635, which discloses a pen barrel capable of demonstrating a variety of patterns. The pen barrel mainly comprises a transparent outer tube 10 and an inner tube 20 received within the outer tube 10. Referring to the FIG. 6, the outer tube 10 has an identification area 11 defined by a plurality of parallel protrusions 12 with arc-shaped cross-section. And the inner tube 20 has pattern area 21 with a plurality of patterns 211, 212, 213 defined by different sets of stripes. Each set of stripes is paralleled and staggered with others, but the patterns defined are overlapped. Thus, a user can see specific one of the patterns 211, 212, 213 in a time via a specific visual angle through the protrusions 12.

It would be desirable to provide a pen with a barrel performing other vision effect.

SUMMARY OF INVENTION

The present invention is directed to a pen that satisfies the desire mentioned above. A pen having features of the present invention comprises a barrel having a first tube and a second tube, the second tube coaxially overlaying the first tube. The first tube has a pattern area defined by a plurality of parallel lines thereon; and the second tube is transparent and has a plurality of parallel protrusions formed thereon; wherein one of the first tube and the second tube is movable relative to another; and the parallel lines of the first tube are parallel with the parallel protrusions of the second tube.

In a preferred embodiment, the pattern area of the first tube is divided into a foreground and a background; and the parallel lines of the pattern area have first stripes defined as the foreground, and second stripes defined as the background, wherein the first stripes are paralleled and staggered with the second stripes.

Accordingly, when one of the first tube and the second tube moves relative to another, the pattern area can be seen as a flashy effect through the protrusions of the second transparent tube.

Further benefits and advantages of the present invention will become apparent after a careful reading of the detailed description with appropriate reference to the accompanying drawings.

BRIEF DESCRIPTION OF DRAWINGS

The invention will now be elucidated by reference to the following description, appended claims, and accompanying drawings where

DETAILED DESCRIPTION OF PREFERRED EMBODIMENTS

With reference to FIGS. 1 to 4, description will be made of a pen according to a preferred embodiment of the subject invention.

Figure 1:
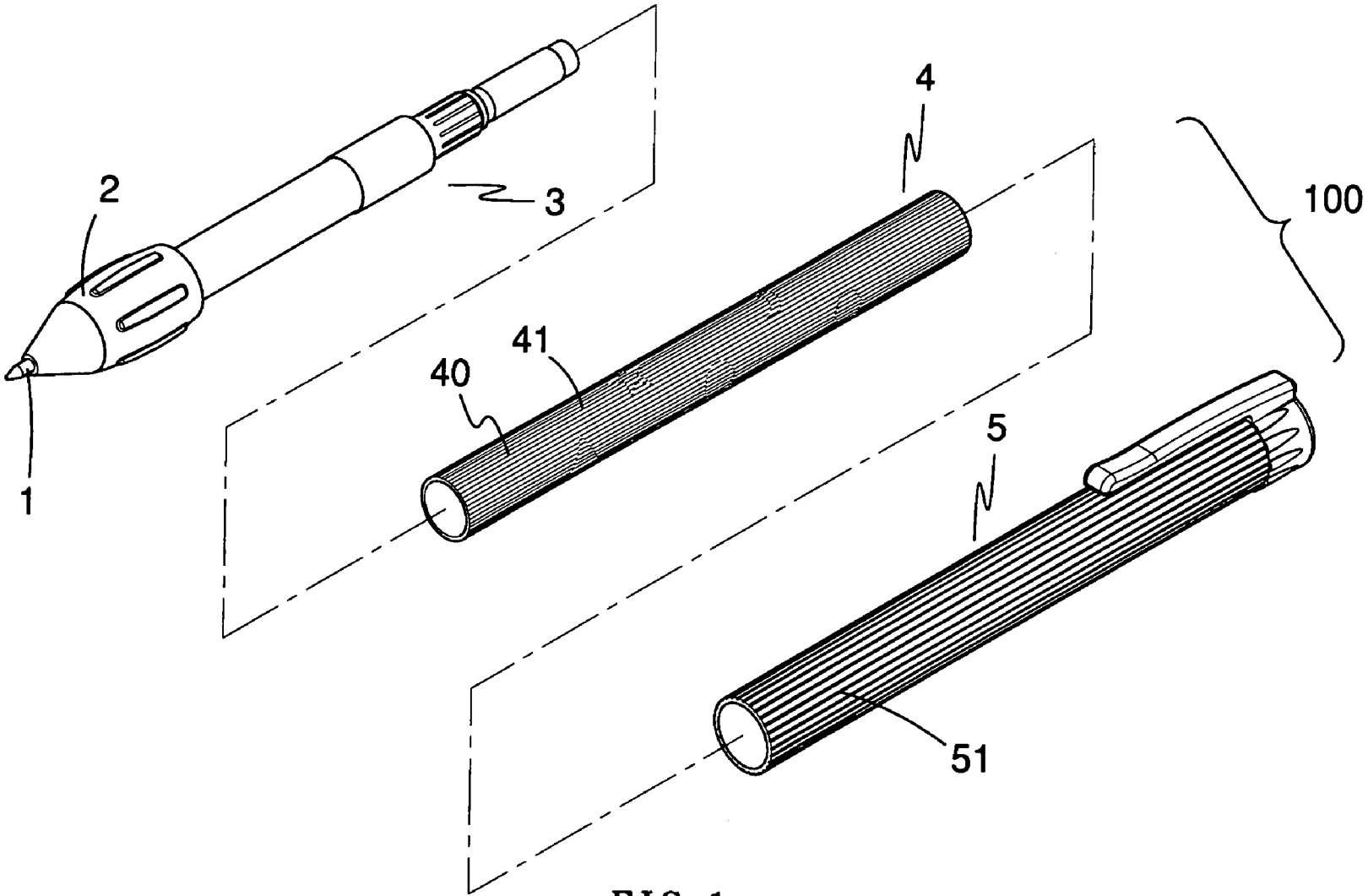
FIG. 1 is an exploded perspective view of a preferred embodiment of the pen of the subject invention.
Figure 3:
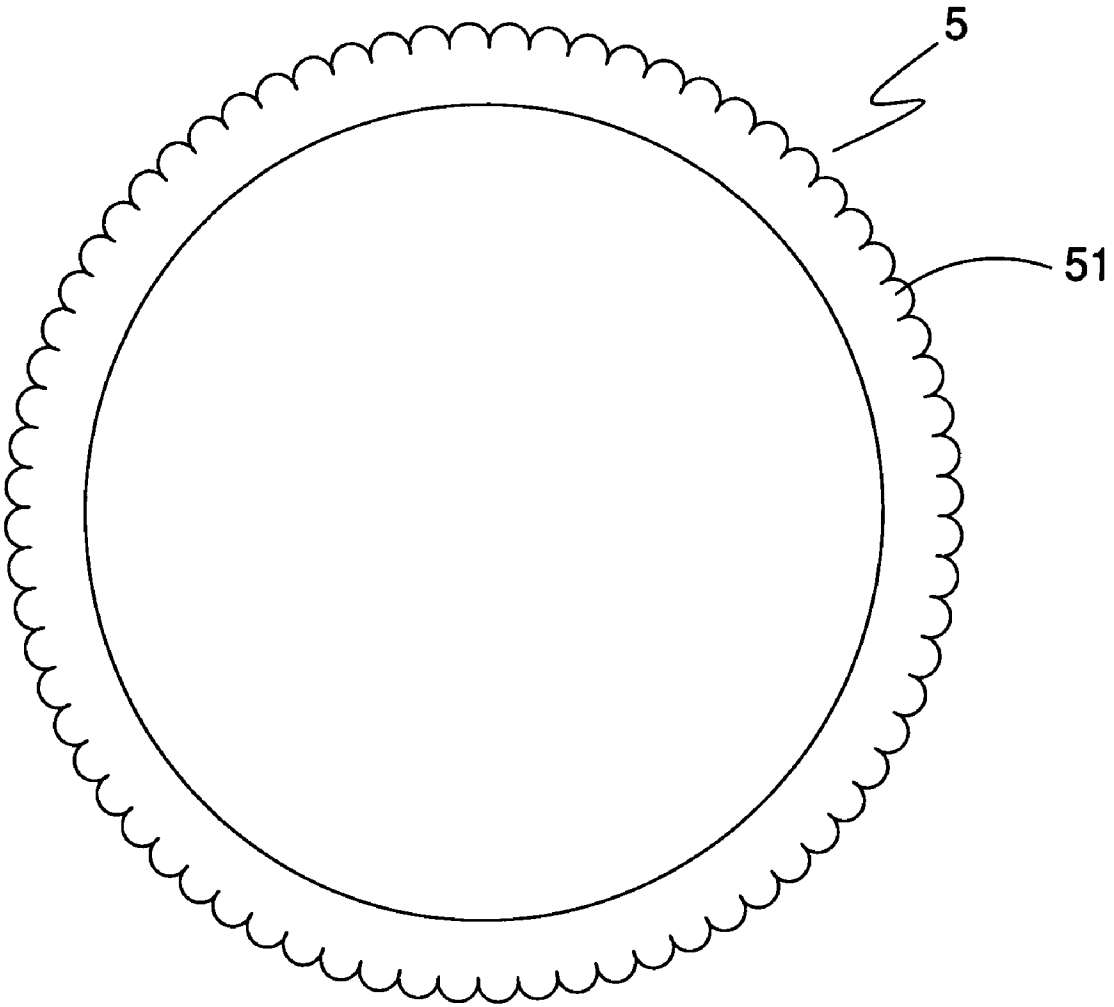
FIG. 3 is a cross-section view of a second tube of the pen in FIG. 1.

As can be seen from FIG. 1, the pen comprises a barrel 100. The barrel 100 has a first tube 4 and a second tube 5 which is coaxially overlaying the first tube 4. The first tube 4 has a pattern area 40 defined by a plurality of parallel lines 41 thereon. Referring to FIG. 3, the second tube 5 is transparent and has a wall formed with a plurality of parallel protrusions 51 corresponding to the parallel lines 41; wherein one of the first tube 4 and the second tube 5 is movable relative to another; and the parallel lines 41 of the first tube 4 are parallel with the parallel protrusions 51 of the second tube 5, as shown in FIG. 3. Accordingly, while operating the barrel 100 of the pen to rotate either the first tube 4 or the second tube 5, a user can see a visual effect in a result of light entering the moving parallel protrusions 51 by different angles of refraction and cooperated with the parallel lines 41 of the pattern area 40.

Figure 2:
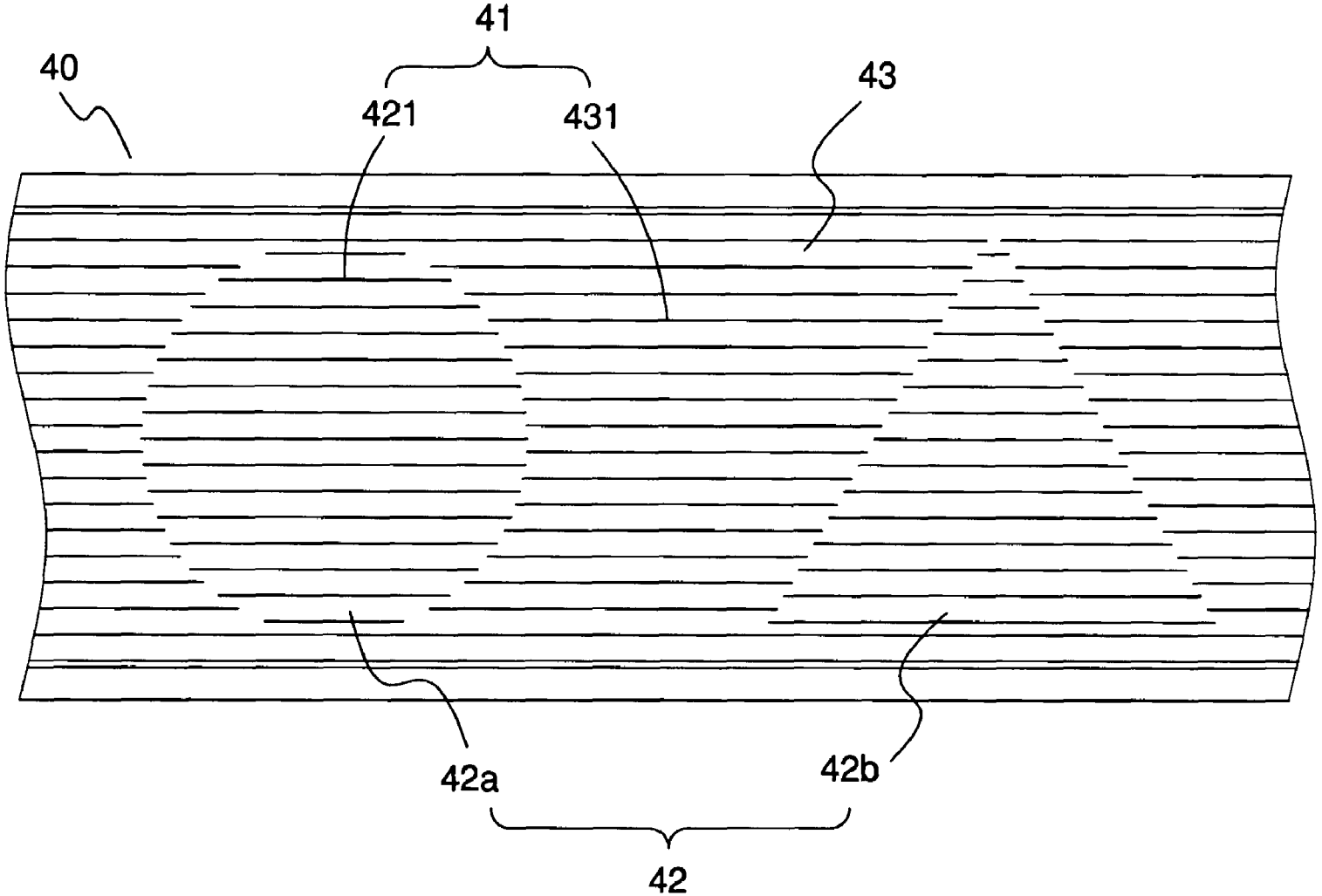
FIG. 2 depicts a pattern area of a first tube of the pen in FIG. 1, showing first stripes and second stripes.

As shown in FIG. 2, the pattern area 40 is divided into a foreground 42 and a background 43. And the parallel lines 41 of the pattern area 40 has first stripes 421 defined as the foreground 42, and second stripes 431 defined as the background 43, wherein the first stripes 421 are paralleled and staggered with the second stripes 431, as the prior art. Unlike the conventional pen, the foreground 42 and the background 43 are not overlapped. Additionally, the foreground 42 can has a variety of patterns 42*a* and 42*b* sited on different areas.

In this case, while either the first tube 4 or the second tube 5 moves, the barrel 100 of the pen of the present invention can be seen as a flashy effect in a result of the illusion developed by the parallel lines 41 and the corresponding parallel protrusions 51. Furthermore, with the background 43 served as a contrast to the foreground 42, the flashy effect can be seen more vivid.

Figure 4:
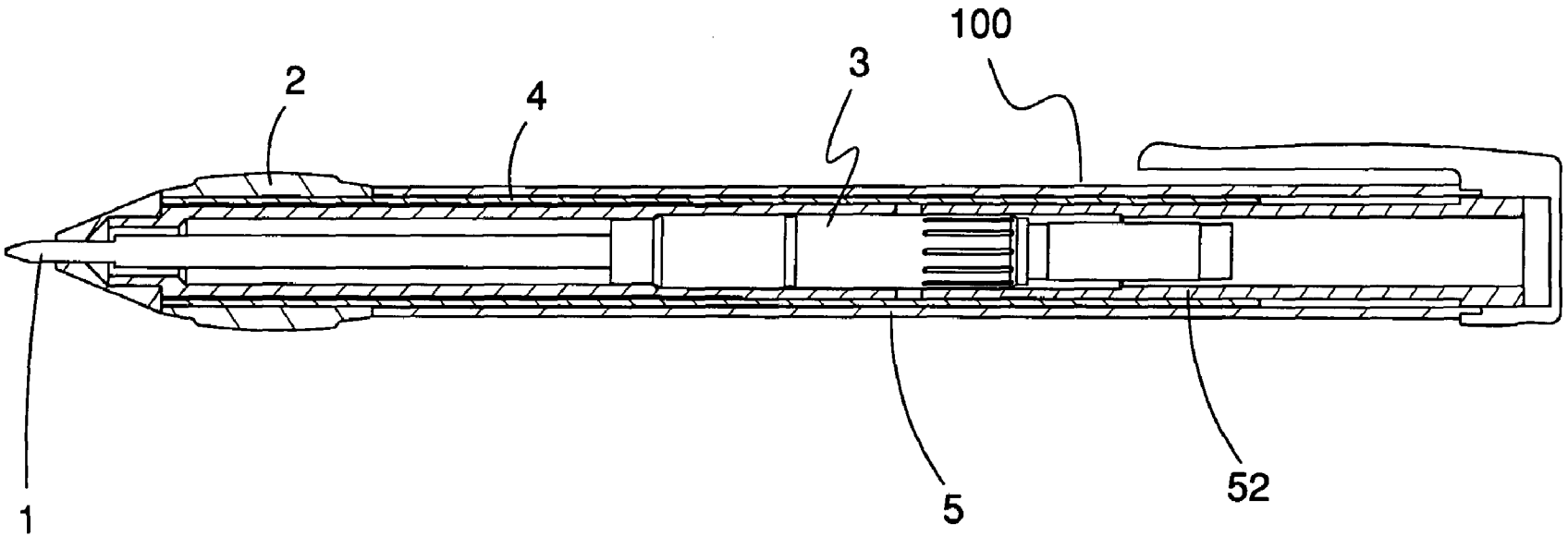
FIG. 4 is a cross-section of the pen in FIG. 1.

In practice, referring to FIG. 4, the pen further comprises a refill 1, a penholder 2 and a driving mechanism 3. The refill 1 is received in the penholder 2. And the driving mechanism 3 can be operated to drive the refill 1 to jut out from or draw back into the penholder 2. In addition, the first tube 4 of the barrel 100 is secured on the penholder 2, and the second tube 5 is provided for driving the driving mechanism 3. In this state, while the user operates or rotates the second tube 5 to drive the driving mechanism 3 to control the refill 11, the second tube 5 simultaneously moves relative to the first tube 4 to perform the flashy effect.

Referring yet to FIG. 4, the second tube 5 of the barrel 100 may further has an inner tube 52 engaged with the driving mechanism 3 so as to drive the same. Accordingly, the second tube 5 can drive the driving mechanism 3 to control the refill 1 and perform the flash effect at the same time via the inner tube 52.

Figure 5:
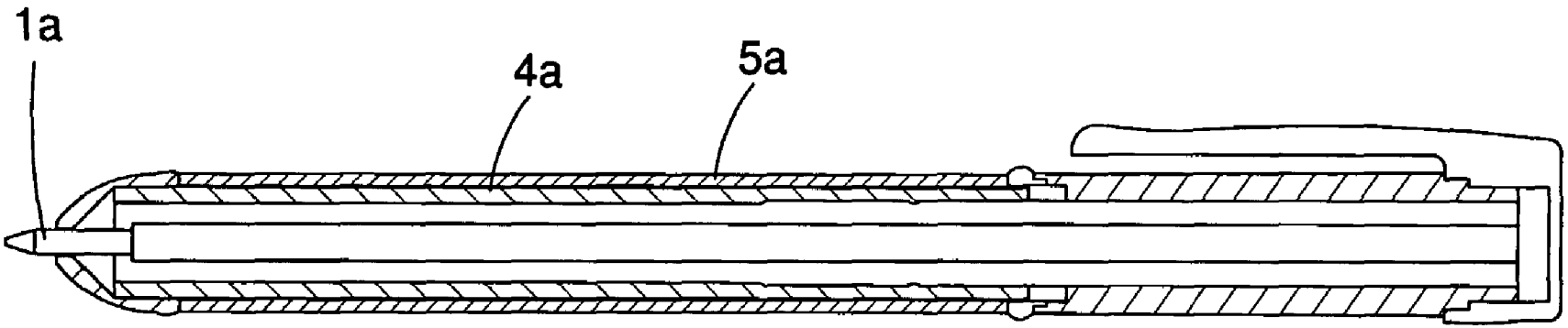
FIG. 5 is a cross-section of another preferred embodiment of the pen of the subject invention.
Figure 6:
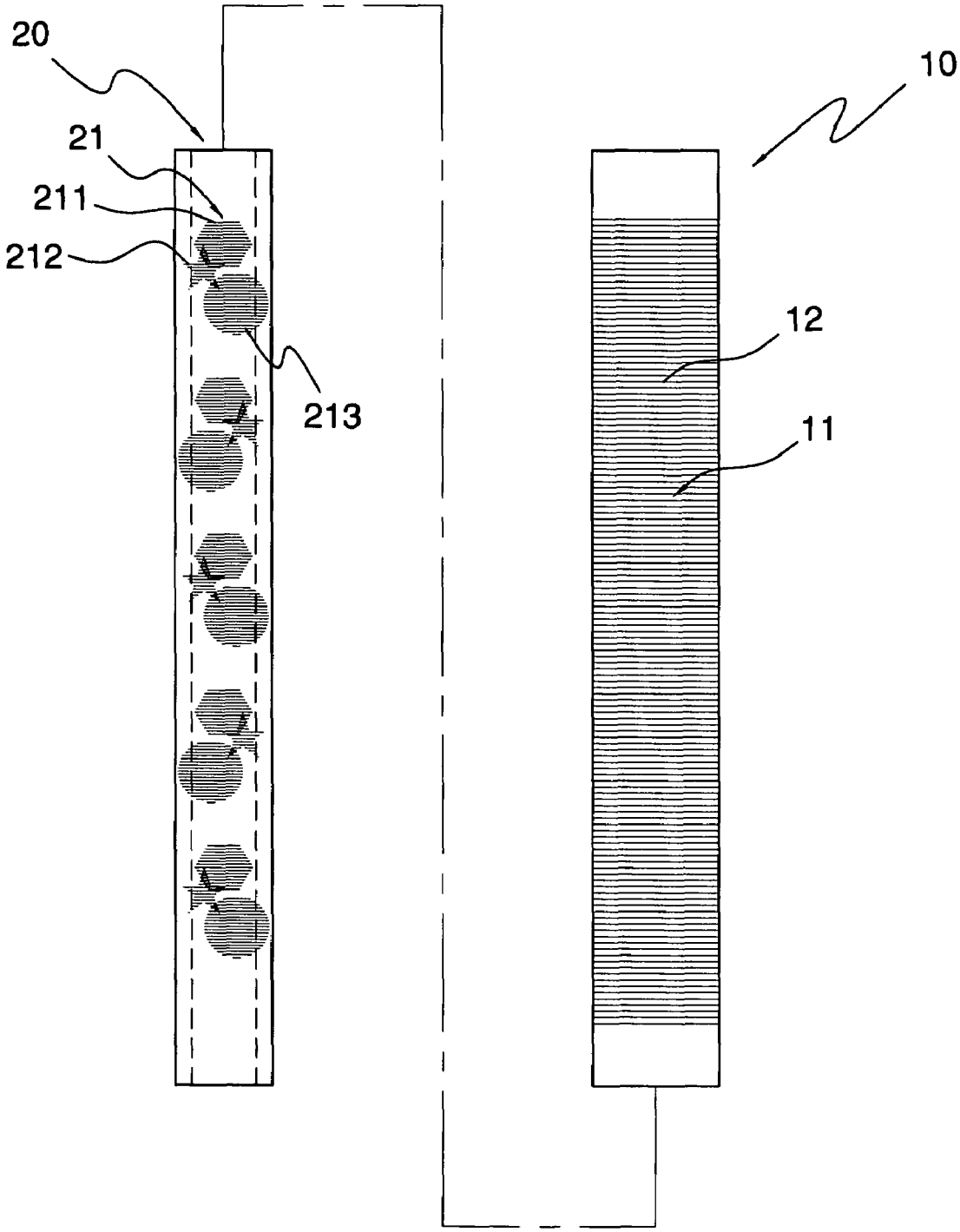
FIG. 6 PRIOR ART
FIG. 6 shows a conventional pen.

Referring to FIG. 5, a pen according to another preferred embodiment of the subject invention comprises a first tube 4*a* and a second tube 5*a*, as the preferred embodiment does, except that the second tube 5*a* is not associated with a refill 1*a* of the pen. A user can just rotate the second tube 5*a* to perform the flash effect.

As compared with both embodiments stated above, it is to be noticed that the first tube of the barrel can be arranged to actively move relative to the second tube by pressing a cap of the pen to perform the flashy effect. Additionally, in one embodiment, the pen of the present invention does not have to having the driving mechanism. In another embodiment, the driving mechanism is not necessary to be driven by the second tube.

In the foregoing embodiments, the relative motion between the first tube having the pattern area, and the second tube having the corresponding transparent protrusion performs the vivid flashy effect.

Numerous characteristics and advantages of the invention have been set forth in the foregoing description, together with details of the structure and function of the invention, and the novel features thereof are pointed out in appended claims. The disclosure, however, is illustrative only, and changes may be made in detail, especially, in matters of shape, size and arrangement of parts, materials and the combination thereof within the principle of the invention, to the full extent indicated by the broad general meaning of the terms in which the appended claims are expressed.

What is claimed is:

1. A pen comprising:

a penholder;

a refill, received in the penholder;

a driving mechanism configured to drive the refill to jut out from or draw back into the penholder; and a barrel including a first tube and a second tube: the first tube having a pattern area defined by a plurality of parallel lines thereon: the second tube being transparent, coaxially overlaying the first tube and having a plurality of parallel protrusions formed thereon, wherein either one of the first and second tubes is movable relative to one another, and the parallel lines of the first tube are parallel with the parallel protrusions of the second tube;

wherein the first tube of the barrel is secured on the penholder, and the second tube is capable of driving the driving mechanism.

2. The pen of claim 1, wherein the second tube has an inner tube engaged with the driving mechanism.

3. A pen comprising:

a penholder;

a refill, received in the penholder;

a driving mechanism configured to drive the refill to jut out from or draw back into the penholder; and a barrel including a first tube and a second tube; the first tube having a pattern area having a plurality of parallel lines which includes first strips served as a foreground of the pattern area, and second strips paralleled, staggered with the first stripes and served as a background of the pattern area; and the second tube being transparent, coaxially overlaying the first tube and having a plurality of parallel protrusions formed thereon, wherein either one of the first and second tubes is movable relative to one another, and the parallel lines of the first tube are parallel with the parallel protrusions of the second tube;

wherein the first tube of the barrel is secured on the penholder, and the second tube is capable of driving the driving mechanism.

4. The pen of claim 3, wherein the second tube has an inner tube engaged with the driving mechanism.

* * * * *